US007866921B2

(12) United States Patent
Stamoulis

(10) Patent No.: US 7,866,921 B2
(45) Date of Patent: Jan. 11, 2011

(54) TOOL AND METHOD FOR EXTRACTING LANDFILL GAS

(76) Inventor: Stefan Stamoulis, 17226 E. Highway 6, Alvin, TX (US) 77511

( * ) Notice: Subject to any disclaimer, the term of this patent is extended or adjusted under 35 U.S.C. 154(b) by 0 days.

(21) Appl. No.: 12/558,203

(22) Filed: Sep. 11, 2009

(65) Prior Publication Data

US 2010/0230111 A1 Sep. 16, 2010

(51) Int. Cl.
*B09B 1/00* (2006.01)

(52) U.S. Cl. ..... 405/129.95

(58) Field of Classification Search ..... 405/129.95; 166/298

See application file for complete search history.

(56) References Cited

U.S. PATENT DOCUMENTS 2,171,442 A * 8/1939 Bynum ..... 166/55.3
2,482,913 A * 9/1949 Jobe ..... 166/55.1
2,884,066 A * 4/1959 Teplitz et al. ..... 166/55
4,442,901 A 4/1984 Zison
4,469,176 A 9/1984 Zison et al.
5,701,958 A 12/1997 Braziel
6,338,386 B1 1/2002 Catania et al.
6,990,879 B2 * 1/2006 Rubino ..... 83/54
7,387,163 B2 6/2008 Seegers et al.
2007/0062701 A1 * 3/2007 Seegers et al. ..... 166/298

OTHER PUBLICATIONS

James D. Bier et al.; Effects of Landfill Gas Management at the Industry Hills Recreation & Conference Center; SWANA 17th Annual Landfill Gas Symposium; Mar. 22-24, 1994.
Paul J. Stout; Effects of Liquid Removals from Landfills on Increasing Leg Flow Rates; 12th Annual Waste Reduction & 5th Annual Collection/Transfer Symposium; Feb. 12-17, 2001.
Bryan A. Stirrat & Ass.; The Influence of Design & Construction on the Performance of Landfill Gas Extraction Wells; SWANA 27th Annual Landfill Gas Symposium; Mar. 22-25, 2004.
Dean Voelker; Landfill Gas Collection System Design & Operation in a Wet Landfill; SWANA 28th Landfill Gas Symposium; Mar. 7-10, 2005.

* cited by examiner

*Primary Examiner*—John Kreck
(74) *Attorney, Agent, or Firm*—Boulware & Valoir

(57) ABSTRACT

An apparatus and method to internally provide apertures inside PVC, HDPE, or plastic pipe-riser (blank casing) in existing methane gas recovery wells (extraction wells) that have been installed at Municipal Solid Waste Facilities are described. Apertures in methane well risers allow methane gas, LFG derived from the decomposition of waste, to enter the existing riser and extraction system. This process saves time and cost associated with drilling additional wells to retrieve methane gas from subsequent layers of the waste body. The process assists in maintaining regulatory compliance by capturing LFG and preventing it from being emitted into the atmosphere.

6 Claims, 8 Drawing Sheets

Not to scale

Not to Scale

N = Ground Surface Elevation

Original Placement of Methane Gas Well with Subsequent Extensions of Riser to Final Grade.

Graphic Representation
Not To Scale

Not to scale

TOOL AND METHOD FOR EXTRACTING LANDFILL GAS

PRIOR RELATED APPLICATIONS

Not applicable.

FEDERALLY SPONSORED RESEARCH STATEMENT

Not applicable.

REFERENCE TO MICROFICHE APPENDIX

Not applicable.

FIELD OF THE INVENTION

The invention is a tool and system for internally providing openings or apertures through a polymeric pipe and a method of using the tool to improve methane extraction, from methane recovery wells at municipal solid waste facilities (MSWFs). The method uses an internal pipe aperture tool to create openings or holes in existing riser pipe extending into the well and to extract additional methane therethrough from methane recovery wells at MSWFs. By providing apertures in the methane well riser pipes, the volume and rate of methane extraction is enhanced, the amount of methane extracted from a given landfill unit is increased and less methane is emitted into the atmosphere. Increasing methane capture and production while reducing methane emissions assists MSWFs in maintaining regulatory compliance. Additionally, the tool can be used to rehabilitate methane extraction wells where the screen zone has been flooded, clogged or otherwise deemed inoperable. The internal pipe aperture tool can be used on methane extraction wells which have been extended after original placement.

BACKGROUND OF THE INVENTION

Methane is a primary constituent of landfill gas (LFG) and a potent contributor to greenhouse gasses. MSWFs are the largest source of human-related (anthropogenic) methane emissions in the United States, accounting for about 25 percent of these emissions in 2004. Additionally, these escaping LFG emissions are a lost opportunity to capture and use a significant energy resource. Substantial energy, economic, and environmental benefits are achieved by capturing LFG prior to release, which subsequently reduces greenhouse gasses. LFG capture projects improve energy independence, produce cost savings, create jobs, and help local economies. LFG is currently extracted from landfills using a series of wells and a vacuum system that consolidates the collected gas for processing. From there, the LFG is used for a variety of purposes including motor vehicle fuel, generator fuel, biodiesel production, natural gas supplement, as well as green power and heating.

Currently, MSWFs bury waste in layers over time (See FIG. 1A). The basic structure is a floor and sidewalls of compacted clay, covered with a HDPE polymer liner, filled with layers of waste alternated with clay or soil layers. Once a landfill has reached a certain capacity, methane recovery wells are installed and gas is extracted from decay and composition of waste layers. As the waste body increases in height, non-apertured "riser pipe", "casing", "riser", or "vertical pipe" is added to the existing extraction well (See FIG. 1B). These terms may be used interchangeably for the tubular members extending into the waste body. Once the waste body reaches the design height or capacity it is covered with compacted soil, topsoil, or possible liner material and subsequently replanted with natural vegetation and left to decompose. LFG is created as the organic fraction of solid waste decomposes in a landfill, due to the process of methogenesis. LFG gas consists of about 50 percent methane ($CH_4$), the primary component of natural gas, about 40-49% percent carbon dioxide ($CO_2$), and a small amount of non-methane organic compounds. Landfills must be monitored over time to ensure that LFG emissions, groundwater leachate, and waste from the solid waste unit are not being released and impacting the environment. Methane extraction and recovery captures LFG and prevents emission of these air contaminants. Methane is first produced in the older, lower decomposing waste bodies. Subsequent layers produce methane at different times and rates (See FIG. 1C). Currently, to extract methane from subsequent layers, wells are drilled to a desired depth or elevation and methane extracted. As decomposition continues shallower and shallower wells are required to reach gasses trapped in upper waste bodies. Currently, to extract LFG from upper shallow zones, a MSWF must drill new, shallower wells, which is a capital intensive process. Multiple wells, pipe, equipment and repeated drilling are required to collect and transport the gas to the collection facility. LFG extraction, recovery and use is a reliable and renewable fuel option that represents a largely untapped and environmentally friendly energy source at thousands of landfills in the U.S. and abroad.

Capture of LFG can be used to produce electricity with engines, turbines, microturbines, or other technologies, used as an alternative to fossil fuels, or refined and injected into the natural gas pipeline. Capturing and using LFG in these ways can yield substantial energy, economic, environmental, air quality, and public health benefits. Internationally, significant opportunities exist for expanding LFG recovery and use while reducing harmful emissions.

Problems exist to rehabilitate existing non-functional wells, for example the wells are often on side slopes or on uneven ground making access difficult. In addition, the pipes often bend and deviate after installation and deviate during waste placement. Annular obstructions from couplers or lag screws or similar type fasteners used to connect additional pipes or risers add to the difficulty of rehabilitation efforts. The position of the landfill gas well, typically protruding from the surface makes a conventional drilling method, i.e., a drilling rig, problematic and renders this methodology difficult, when used to rehabilitate or fix a non-functional well. Many methane well locations are logistically difficult and impossible to reposition and reenter an existing well with conventional equipment. Trying to insert drill pipes in the annulus of methane gas wells is difficult due to deviations and bends in the well casing. These and other issues severely limit the reliable available methods which can be used to achieve success in the well rehabilitation and production enhancement process. A tool and method of ventilating existing methane wells is required that would not damage the vertical pipe while allowing methane gas to enter the riser from waste bodies and various elevations within the same well location and would operate safely in this type of environment.

SUMMARY OF THE INVENTION

Embodiments of the invention provide a tool, method and system for extracting landfill gas (LFG) from a landfill gas recovery well. In some embodiments, the tool includes: (a) a housing sized to be placed within the internal diameter of a landfill gas recovery well casing; (b) one or more pistons positioned inside the housing capable of extending from the housing positioned inside the gas recovery well casing to create an aperture through the landfill gas recovery well casing; and (c) passages in the housing to the piston to provide motive fluid. The motive fluid may provide a pressure ranging from about 1000 to about 3500 psi. In some embodiments, the aperture is generally circular with a diameter ranging from about ¼ inch to about 1 inch. The landfill gas recovery well casing may have an outer diameter of approximately 6 to approximately 8 inches. In some embodiments, a carrier maneuvers the tool into the landfill gas recovery well casing and provides the motive fluid to the tool. The motive fluid may be hydraulic, pneumatic, or fossil fuel. In some embodiments, the carrier comprises a truck and trailer, a tractor which can pull a trailer, or a small track mounted unit and may be a radio controlled unit or a self propelled unit.

In some embodiments, the method of producing landfill gas from an existing landfill gas recovery well includes: (a) positioning the aperture tool within the internal diameter of the landfill gas recovery well casing, said aperture tool comprising a housing, one or more pistons positioned inside the housing capable of extending from the housing to create an aperture through the landfill gas recovery well casing, passages in the housing to the piston to provide motive fluid; (b) providing motive fluid to the piston of the aperture tool to create apertures through the landfill gas recovery well casing with a pressure ranging from about 1000 to about 3500 psi, and (c) producing landfill gas after the apertures are created in the well casing. In most embodiments, the gas recovery well casing is a polymer. The steps may be repeated in more than one landfill gas recovery well casing. In some embodiments, the landfill gas is collected and the landfill gas meets New Source Performance Standards.

In some embodiments, a system for enhancing the extraction of landfill gas (LFG) from a landfill gas recovery well includes: (a) a mobile carrier; (b) a portable aperture tool for creating openings in a landfill gas recovery well casing movable to a landfill gas recovery well by the mobile carrier which positions the portable tool within the landfill gas recovery well casing at the desired depth; (c) said portable tool comprises a housing with at least one piston for creating an aperture by expanding the piston in the casing extending in the landfill gas recovery well casing; (d) a passage for motive fluid between a reservoir outside the recovery well casing and the piston; and (e) a pressure creating means for operating motive fluid to force the piston against the internal wall of the recovery well casing and create an aperture therethrough for flow of LFG. In some embodiments, the mobile carrier also includes leveling mechanisms and control mechanisms for operating the portable aperture tool and a winch for positioning the portable tool within the landfill gas recovery well casing at the desired depth.

DESCRIPTION OF EMBODIMENTS OF THE INVENTION

Figure 1A:
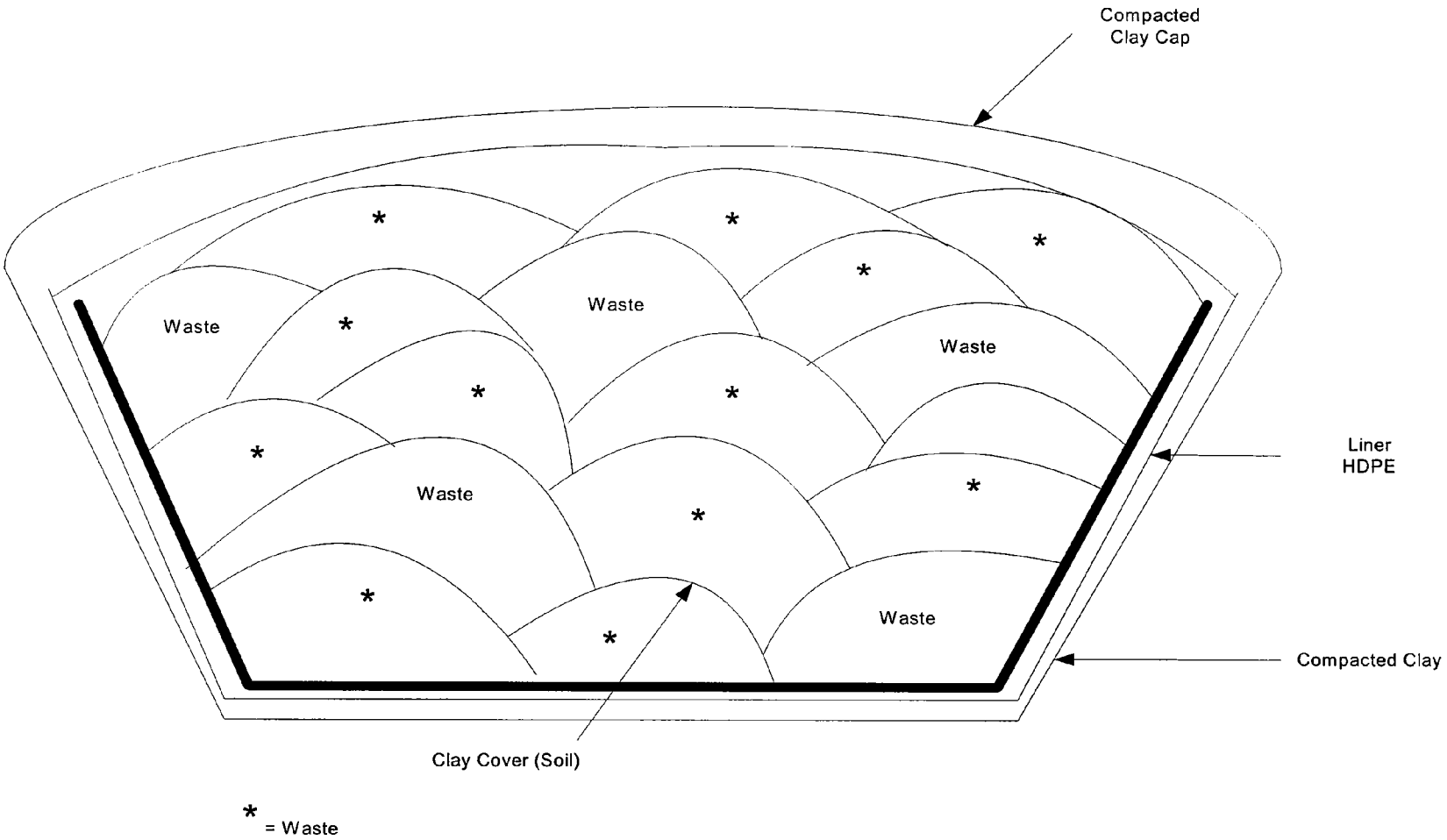
FIG. 1A is a schematic representation of an embodiment of a landfill with a compacted clay floor, HDPE liner, waste, cover soil and a compacted clay cap.
Figure 1B:
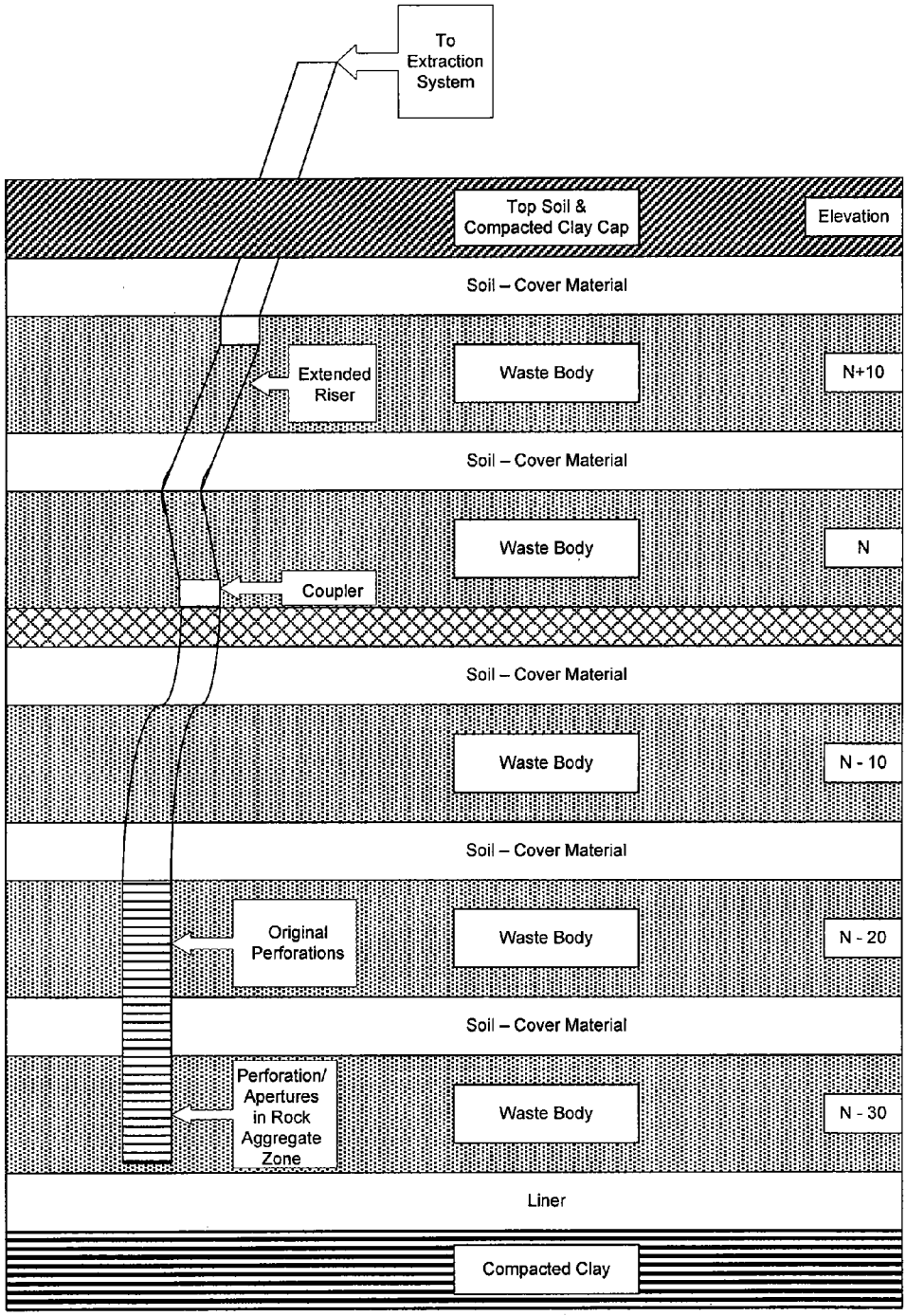
FIG. 1B is a schematic representation of an embodiment of a landfill gas extraction system having apertured riser pipe along with extended riser placed after the original placement and installation.
Figure 1C:
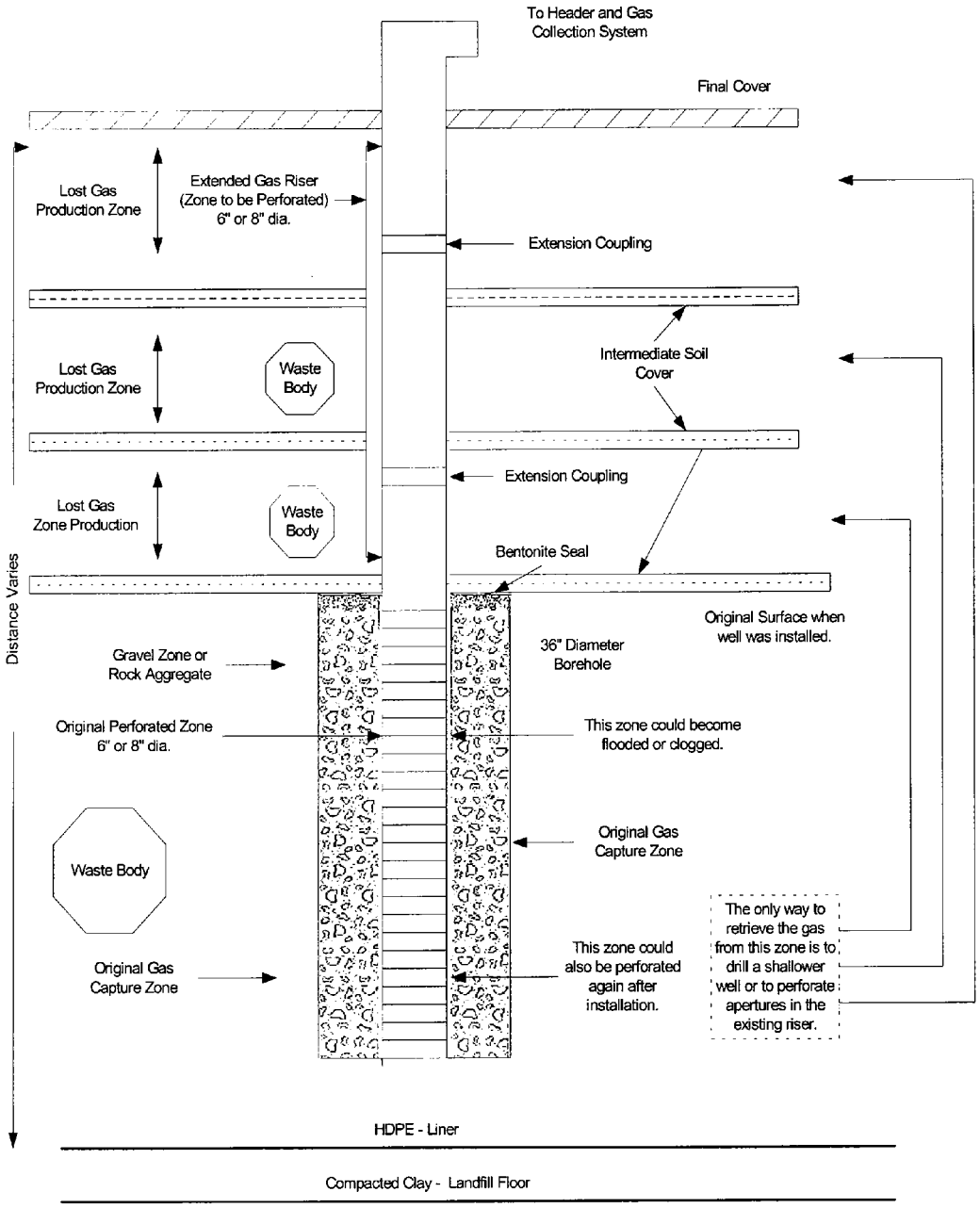
FIG. 1C is a schematic representation of an embodiment depicting a function of the tool.

Referring to FIGS. 1A-1C, the landfill gas well includes a rock aggregate and prior perforated zone in a waste body for methane extraction, a riser pipe that carries the methane to the surface header and subsequent gas collection system. A methane extraction well is drilled into a waste body at a specific depth or elevation. Often the casing having a screen zone is installed early in the life of the landfill and risers or riser pipes are attached as the waste height is increased. Solid waste bodies are formed in waste-body layers as the landfill matures. To extract gas from waste bodies when a riser has been added to extend the original well, additional apertures would be required. The current method would include drilling a new well adjacent to the old location and placing screen above the original well screen. Embodiments of this invention eliminate the need to drill an adjacent well. Embodiments of the current invention provide for additional apertures within the same well above the original screen zone, see FIG. 1C, to capture production zones above the original placement.

As used herein "casing", "riser", "riser pipe" or "pipe" is defined as any length of pipe and may be used interchangeably for the tubular members extending into the waste body. Due to shifting waste bodies, imperfections in drilling or placement of pipe, and deviation in pipe over time, the pipe may depart from vertical and may even approach horizontal at places within the well. Polymeric pipe materials include plastic materials, such as but not limited to, polyvinyl chloride (PVC), chlorinated polyvinyl chloride (CPVC), polyethylene (PE), high-density polyethylene (HDPE), cross-linked high-density polyethylene (PEX), polybutylene (PB), and acrylonitrile butadiene styrene (ABS), for example.

The internal pipe aperture tool is used to create apertures or openings inside existing landfill gas riser pipes, either above the original perforated section or within the original perforated section, to allow additional production of gas from the existing or upper zones or in wells where LFG production is reduced or completely inoperable. The terms aperture and opening are used interchangeably and describe the openings created by the tool in the gas recovery well casing. The openings can be any shape but typically are generally circular in shape. The tool is designed to fulfill the needs of owners and operators at landfill facilities. It provides ventilation to originally perforated zones or riser pipes initially installed in the waste body and extended with additional riser as waste is added. The amount of riser can reach lengths of approximately 50 feet or more above the original aperture section of the well. In some embodiments, the tool can operate the length of the entire gas recovery well casing.

Figure 2:
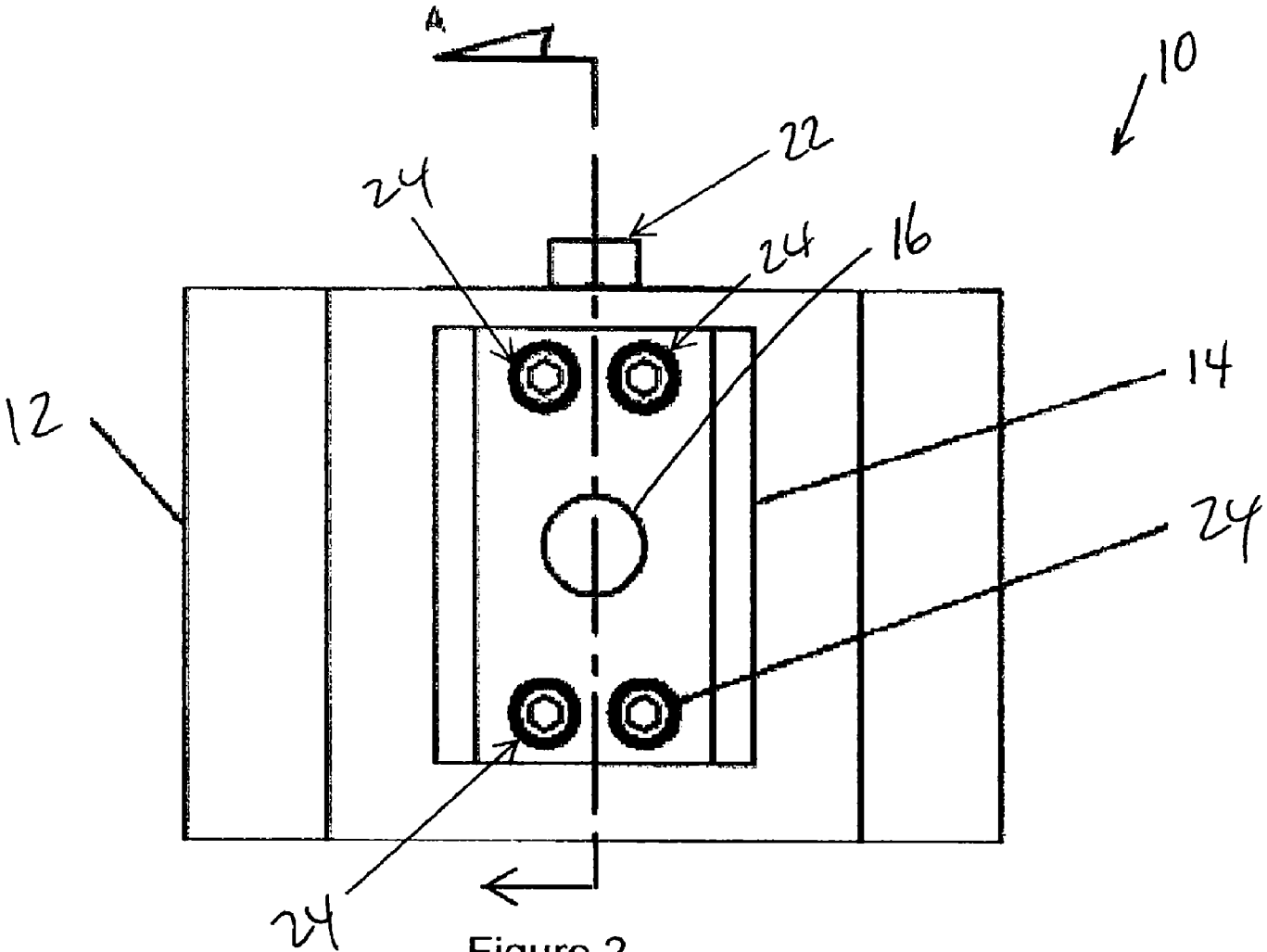
FIG. 2 is an embodiment of a tool for enhancing the extraction of landfill gas.
Figure 3:
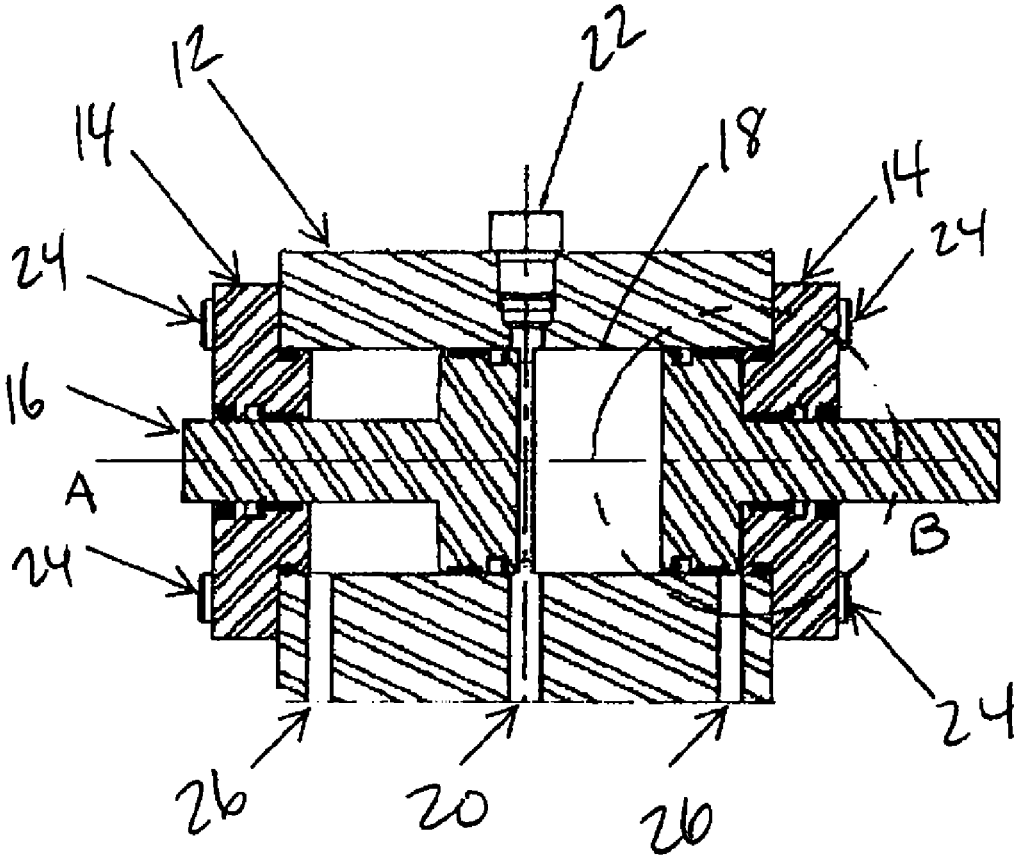
FIG. 3 is a cutaway view of the tool of FIG. 2.
Figure 4:
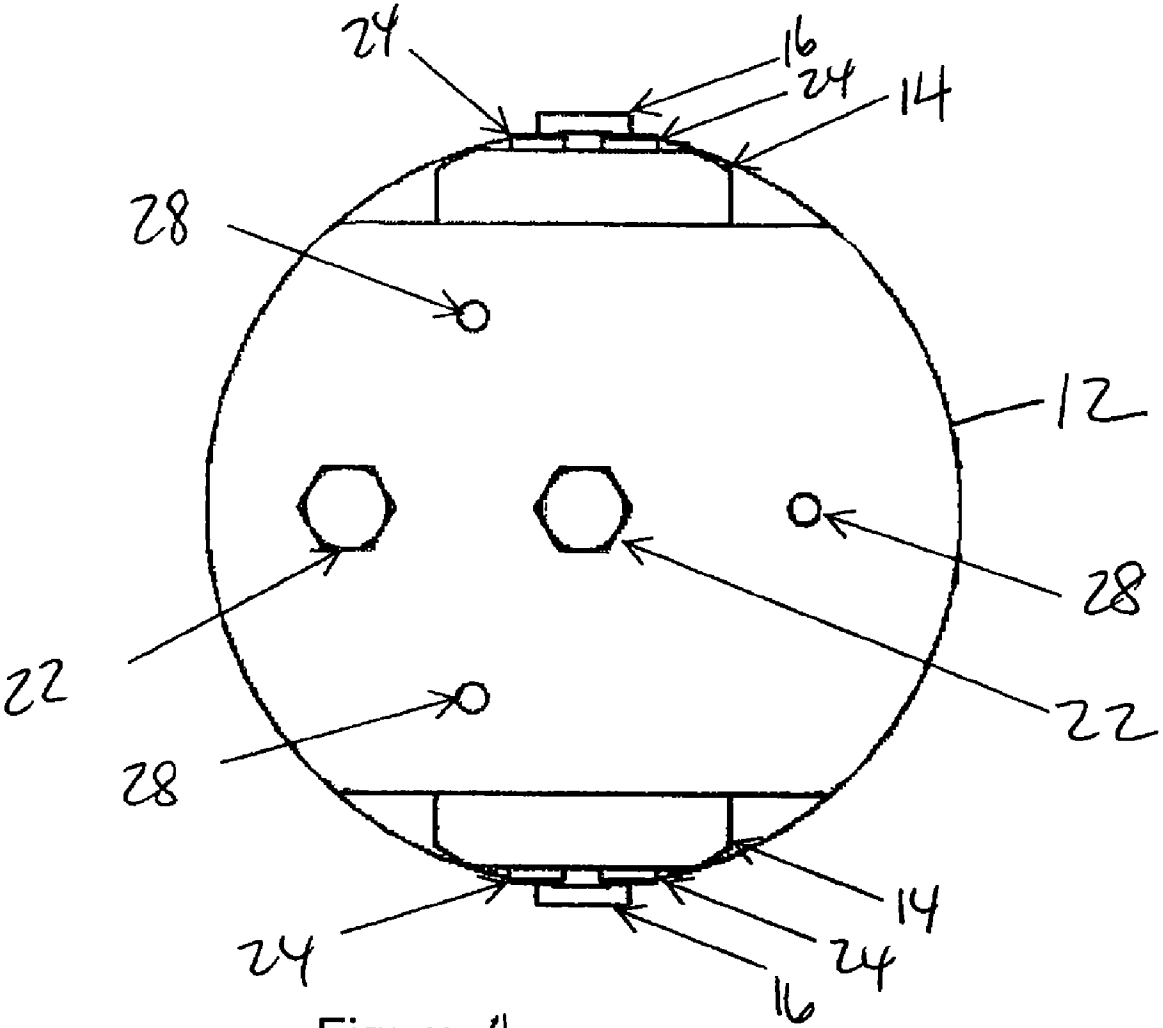
FIG. 4 is top view of the tool of FIG. 2.

FIGS. 2-4 are various views of an embodiment of the internal pipe aperture tool 10 including a housing 12, a plate 14 and one or more pistons 16. The same number is used across the figures to describe the same part. The tool 10 may be plastic, ceramic, metal, carbon steel, cast aluminum, stainless steel, or brass. In a preferred embodiment the body is cast aluminum, carbon steel, stainless steel, or brass providing both a durable casing and a weight, between about 5 and about 30 pounds. Preferably the tool weighs between 20 and 25 pounds. The weight of the tool 10 will vary based upon the material, size and shape of the tool. The tool 10 is preferably less than 1 foot long, preferably, more preferably about 7 inches long. The size of the tool 10 is dependent on the size of the pipe it is to be used in, but is preferably minimized in length to navigate the inside diameter of the pipe.

The housing 12 may be an elongate oval, cylindrical, spherical, or any geometrical shape capable of being placed within the landfill gas recovery well pipe. The housing 12 is sized to be placed within the casing of a landfill gas recovery well. The landfill gas recovery well casing may be a polymeric pipe, such as but not limited to, polyvinyl chloride (PVC), chlorinated polyvinyl chloride (CPVC), polyethylene (PE), high-density polyethylene (HDPE), cross-linked high-density polyethylene (PEX), polybutylene (PB), and acrylonitrile butadiene styrene (ABS). The tool can be sized, retrofitted and adapted to the different thicknesses and diameters found in the polymeric pipes. The pipes are commonly rated for different psi ratings and will have varying wall thicknesses. The outer diameter of the pipe may vary from about 6 inches or larger, typically 6 to 8 inch methane gas wells are common.

The diameter of the tool 10 is narrower than the internal diameter of the pipe. Although ideally the pipe would be vertical, the pipe may have bends or deformations and obstructions that may intrude into the interior of the pipe. Thus the tool body should be less than about 85%, preferably less than about 80%, more preferably less than about 75%, and most preferably less than about 60% of the pipe's internal diameter. In one embodiment, the tool is less than about 5 inches in diameter. In a preferred embodiment, the tool is between about 2 and about 6 inches in diameter, more preferably between about 3 and about 5 inches for use in standard pipe diameters. The size of the tool 10 will be dependent on the size of the pipe it will be used in and the diameter of the tool is dependent on the internal pipe diameter.

The tool 10 is sized to expand to the internal diameter of the pipe and provide apertures through the pipe. In one embodiment, the tool 10 can expand from about 5 to about 7⅜ inches in diameter. In another embodiment, the tool 10 can expand from about 7½ to about 9⅜ inches in diameter. In a preferred embodiment, the tool expands to greater than 7 inches in diameter. In some embodiments, the tool makes an approximately ¼ inch aperture in the pipe wall. The apertures may range from about ¼ inch to about 1 inch. The size of the aperture will be dependent upon the size of the diameter and thickness of the pipe it will be used in. The tool may create apertures in a variety of pipe materials including schedule 80 PVC pipe, HDPE, or other polymeric pipe materials.

The housing 12 and plate 14 are mechanically coupled to provide a passage 18 which allows the piston 16 to move, in an axis perpendicular to the lateral axis of the housing, from an unextended (FIG. 3, A) to extended position (FIG. 3, B). The housing 12 further includes a set of bores 20 which laterally traverses the height of the housing 12. The bore 20 will provide an inlet and an outlet passage for the motive fluid to move the piston 16. In some embodiments the bores 20 includes a pair of fitting 22 inserted therein. The housing 12 and plate 14 may be coupled by attachment means 24. Some examples of attachment means include, but are not limited to, clamps, screws, and the like. The fitting 22 provides attachment means to the motive fluid at the surface via cables or hoses. One or more passages 26 may be provided to supply motive fluid to one or more tools 10. If only one tool 10 is being operated, plugs (not shown) will be placed in passage 20 and passages 26. If more than one tool is being operated, fittings 22 will be inserted into passages 26 to supply the motive fluid to the tools 10. In some embodiments, attachment means 28 are coupled to the top of the housing 12. The attachment means 28 could be hooks, clamps, screws or the like.

During operation, motive fluid provides pressure to the piston 16. The motive fluid may provide a pressure ranging from about 1000 to about 3500 psi. The piston 16 is pushed against the internal walls of the pipe, preferably creating apertures in the pipe and providing ventilation apertures, allowing LFG to enter the well and increase recovery volume and rate. In some embodiments, the piston 16 will create apertures in the landfill gas well, where the riser is adjacent to waste, soil or rock aggregate. The piston 16 preferably provides apertures ranging from about ¼ inch to about 1 inch, but different sized apertures may be used depending on the size of the pipe and the wall thickness. In some embodiments, the apertures are circular but may be any geometric shape. In some embodiments, the pistons 16 may be positioned on opposing sides of the pipe, either 180° apart for two pistons, 120° for three pistons, or 90° for four pistons. In other embodiments, the pistons 16 may be spaced in other configurations depending on the size of the pipe and wall thickness.

The tool 10 is preferably mounted on a carrier 50 which will transport the tool to the desired location and position the tool over the opening of the landfill gas well. The carrier 50 may be a truck and trailer, a tractor which can pull a trailer, a small track mounted unit, either a radio controlled unit or a self propelled unit. In a preferred embodiment, the carrier 50 can traverse in, on or over ground which is: even, uneven, level, unlevel, wet or dry, dirt, clay, soil, sand or grassy or any combination thereof. Furthermore, the carrier 50 can also be transported up and down inclines and slopes. In some embodiments, the carrier 50 will transport the tool to and from difficult locations on side slopes and low lying areas, or areas which have had differential settling.

In some embodiments, the carrier 50 will be supplied with either manual, mechanical or hydraulic jacks or elevators for assuring the carrier will be leveled for safe operation. In some embodiments, the tool 10 can be operated via pressure supplied by a motive fluid including diesel, hydraulic fluid, compressed air, or other non-sparking motive fluid supply mounted on the carrier 50. In some embodiments, the motive fluid is supplied by a pump. The pump may provide approximately 8 horsepower to approximately 100 horsepower, preferably between about 10 horsepower and about 15 horsepower. A larger or smaller pump may be used dependent upon the size of the pipe and the size of the tool. The pump transmits motive fluid through hoses to the tool 10 through connectors and fittings known to one skilled in the art and described above. In some embodiments, the use of a small track mounted tool will reduce the damage to the clay and landfill cap in areas of final cover. In some embodiments, the ground bearing pressure, depending on track widths, may be as little as about 3.7 to about 5.2 psi.

Operation of the tool 10 may include lowering the tool, positioning the tool, activating the tool, and retrieving the tool. In some embodiments, the tool 10 is positioned within the well casing using a hydraulic or electric crane apparatus which is located on the carrier. The tool 10 is preferably operated from about 10 to about 15 feet below the well surface and may achieve depths of from about 150 to about 160 feet or more below well surface. The tool 10 is preferably sized to be positioned within the landfill gas well (or casing) and be able to pass obstructions, such as but not limited to, couplers, bolts, lag bolts or any other down hole obstruction. The tool 10 also preferably is able to be used in vertical, horizontal, slanted wells or wells with deviations and/or offsets.

In some embodiments, the tool may be used on landfill gas wells which already have perforations therethrough. The tool may be lowered into a well and encounter water, leachate or corrosive liquid. The tool can safely operate in a section of the well below this liquid level. The tool can be positioned to achieve ventilation adjacent to, at or just above the existing perforations. The tool can be raised to open an avenue of gas previously unattainable by the original perforations. The tool will provide new apertures at a depth below 10 to 15 foot below the surface to ensure that oxygen does not intrude into the well vacuum system. If required, the tool can be utilized in the existing perforation section of a landfill gas well to rehabilitate non-functional wells, or low producing existing production zones. The apertures will provide additional open area for gas to enter in these existing perforation zones. The tool and process can be repeated multiple times if additional riser pipe is added to the well location. The process can be repeated months or years after the original installation of the well. The process allows for capturing gas in stages to minimize the release into the atmosphere, whereby reducing emissions of green house gases.

In some embodiments, more than one tool 10 may be lowered into the well. In a preferred embodiment, the plurality of tools may be mechanically coupled together by welding or attachment means such as, but not limited to, clamps, screws, and the like. The plurality of tools 10 may be coupled via hoses, cables, or springs. The tool 10 can be used in explosive or non-explosive environments. In a preferred embodiment, the tool 10 can be used in all ranges of the explosivity range of methane, above, below or within. After the apertures are made, the motive fluid direction is changed and the pistons retracted. The tool can be repositioned and the process repeated until a desired number of apertures is achieved. In a preferred embodiment, a wire cable is used to lower the tool 10. In some embodiments, the tool can be designed to have holes drilled longitudinally, along the axis or length of the tool. Therefore, if the tool were to become lodged in the well, the flow of gas would not be restricted from elevations and zones below the tool.

The tool may be run in an explosive environment; therefore a non-sparking motive fluid source is preferred. In one embodiment air or hydraulic fluid is used to operate the tool. In a preferred embodiment, a pump connected to a hydraulic feed and return line are used to pressurize the tool 10 and recirculate hydraulic fluid. Additionally, a steel cable, rope, or pipe may be attached to the tool for positioning the tool 10 within the pipe. The tool can be operated without altering the conditions in the annular space of the gas well. The tool can operate safely without inserting any type of inert gases, air, or water. In some embodiments, the tool can be operated using biodegradable hydraulic fluid, or a similar material, to prevent any adverse conditions in the event of a seal or O-ring leakage from the tool.

In one embodiment, the motive fluid fittings are recessed in the housing 12. The motive fluid fittings may also be coupled, or encased in an end-cap using a variety of connectors known to one of ordinary skill in the art. Connectors include, but are not limited to, screw-type connectors, hydraulic connectors, pressure fittings, and the like.

Figure 5:
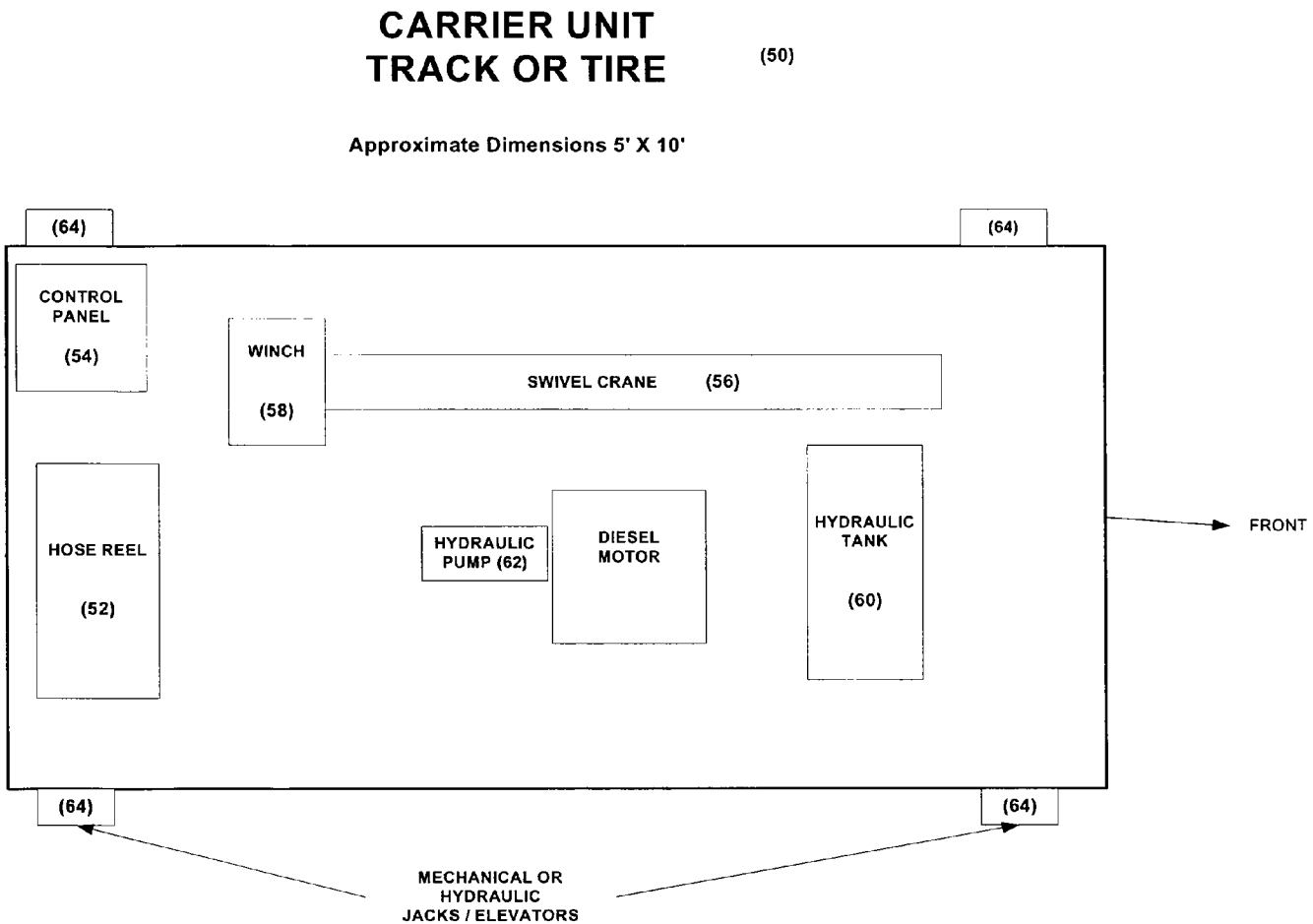
FIG. 5 is a schematic representation of an embodiment of a carrier for the tool.

An exemplary embodiment of the carrier 50 is shown in FIG. 5. For a hydraulically powered tool, the carrier 50 may include a reel 52, a control panel 54, a swivel crane 56, a winch 58, a hydraulic fluid tank 60 a hydraulic pump 62, and manual elevators 64. The reel 52 provides the hydraulic hoses which when attached to the tool 10 will provide the motive fluid. The control panel 54 controls the hydraulic pump 62 to assure that the motive fluid is provided for at the proper pressure. The control panel 54 will also be used to reverse the direction of the motive fluid to retract the piston. The swivel crane 56 and winch 58 provide wire cable for positioning the tool 10 within the pipe. The hydraulic fluid tank 60 and pump 62 provide the motive fluid to the tool 10 via the hydraulic hoses.

Figure 6:
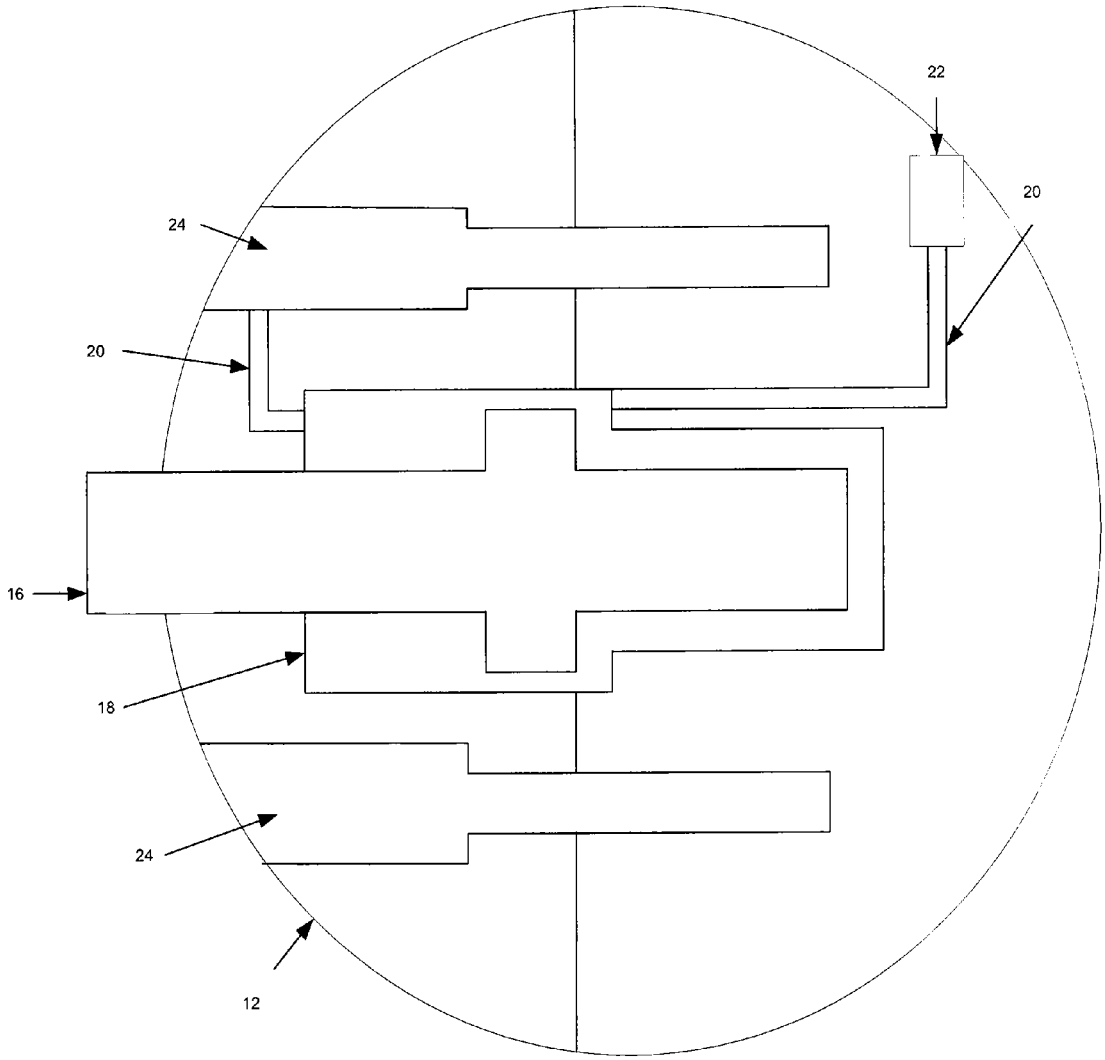
FIG. 6 is a schematic representation of an alternate embodiment of a tool for enhancing the extraction of landfill gas.

In an alternate embodiment of the tool 10, as shown in FIG. 6, the housing 12 is spherical in shape and includes two portions. The two portions of the housing are mechanically coupled to provide passage 18 which allows the piston 16 to move, in an axis perpendicular to the lateral axis of the housing 12. The housing 12 further includes a set of bores 20 which traverses the diameter of the housing 12. The bore 20 will provide an inlet and an outlet passage for the motive fluid to move the piston 16. In some embodiments one of the bores 20 includes a fitting 22 inserted therein. The two portions of the housing 12 may be coupled by attachment means 24. Some examples of attachment means 24 include, but are not limited to, clamps, screws, and the like. The fitting 22 provides attachment means to the motive fluid at the surface via cables or hoses.

All parts are commercially available, but may be manufactured to meet the specifications described herein if custom sizes or materials are desirable. Additionally, the tool may be scaled for larger or smaller pipes thus the part selected may be replaced with an appropriately sized part.

Examples of Tool Operation

Methane wells may be ventilated when methane production from a given well is reduced due to clogging, flooding, pipe damage, or other factors that may make the well underperform or otherwise be inoperable. Wells may also be ventilated to assist wells in meeting compliance requirements. A pipe may also have apertures provided as upper waste bodies begin to produce methane, or pipes may be vented in an effort to reduce total methane emissions. First, a visual inspection of the vertical pipe ensures the riser is continuous and not damaged. A video camera can be run down the pipe to identify obstructions, mark depths and identify any bends in the pipe. Depths of target waste body and desired areas for apertures are then diagrammed and the amount of apertures required for the riser length is calculated. The internal tool is lowered down the vertical pipe (or pushed if a solid pipe, bar, or wire is attached) to the desired depth. Operation is initiated by pressurizing the tool and expanding the piston to the walls of the pipe. Once the pipe is punctured, the piston is retracted. The tool may be rotated to add additional openings at the same elevation or raised to add apertures at a different elevation. The tool is removed when the desired amount of apertures are produced. If required a video camera may be used to verify aperture depth and size. The methane wells are then monitored and compared to prior methane production.

Flow and composition of the landfill gas can be measured and monitored using a gas meter or gas meters capable of being calibrated and obtaining readings for $CH_4$, $CO_2$, $O_2$, % LEL $CH_4$, temperature, static pressure, differential pressure, gas flow rates and BTU content. Readings may be taken before using the aperture tool (pre-aperture) and after using the aperture tool (post aperture). Readings can be evaluated by gas composition % by volume $CH_4$, $CO_2$, $O_2$, % LEL $CH_4$, temperature, static pressure, differential pressure, gas flow rates and BTU content can be evaluated. The following data was collected from seven wells, pre and post use of the tool.

| | Pre-Aperture | Post Aperture |
|---|---|---|
| Well A | | |
| Methane (wt %) | 43.9 | 46.2 |
| Carbon dioxide (wt %) | 33.7 | 38.3 |
| Oxygen (wt %) | 4.5 | 2.1 |
| Balance Gas (wt %) | 17.8 | 12.8 |
| Flow (SCFM) | 0 | 11 |
| Well B | | |
| Methane (wt %) | 40.0 | 47.3 |
| Carbon dioxide (wt %) | 34.7 | 39.3 |
| Oxygen (wt %) | 4.2 | 2.5 |
| Balance Gas (wt %) | 21.1 | 11.4 |
| Flow (SCFM) | 0 | 11 |
| Well C | | |
| Methane (wt %) | 15.1 | 44.0 |
| Carbon dioxide (wt %) | 11.5 | 38.7 |
| Oxygen (wt %) | 15.2 | 1.9 |
| Balance Gas (wt %) | 58.2 | 15.6 |
| Flow (SCFM) | 0 | 8 |
| Well D | | |
| Methane (wt %) | 40.8 | 51.7 |
| Carbon dioxide (wt %) | 25.1 | 39.2 |
| Oxygen (wt %) | 5.1 | 0.4 |
| Balance Gas (wt %) | 29.0 | 8.6 |
| Flow (SCFM) | 0 | 43 |
| Well E | | |
| Methane (wt %) | 49.0 | 49.6 |
| Carbon dioxide (wt %) | 42.5 | 39.5 |
| Oxygen (wt %) | 0.6 | 1.0 |
| Balance Gas (wt %) | 7.9 | 9.7 |
| Flow (SCFM) | 5 | 44 |
| Well F | | |
| Methane (wt %) | 46.5 | 50.1 |
| Carbon dioxide (wt %) | 38.0 | 40.1 |
| Oxygen (wt %) | 1.9 | 0.8 |
| Balance Gas (wt %) | 13.7 | 8.9 |
| Flow (SCFM) | 8 | 34 |
| Well G | | |
| Methane (wt %) | 25.5 | 52.0 |
| Carbon dioxide (wt %) | 27.6 | 26.0 |
| Oxygen (wt %) | 6.8 | 3.1 |
| Balance Gas (wt %) | 40.0 | 20.6 |
| Flow (SCFM) | 0 | 6 |

From the results above, increases in the flow of landfill gas occurred at all wells. Furthermore, the amount of methane was increased. If oxygen levels went above 5%, the landfill gas well would be out of compliance with the New Source Performance Standards (NSPS). The above data shows that the apertures in the casing treated with the aperture tool decreased the amount of oxygen in the captured LFG. The landfill gas wells should meet the standards set by the Environmental Protection Agency, such as "Standards of Performance, Emission Guidelines, and Federal Plan for Municipal Solid Waste Landfills and National Emission Standards for Hazardous Air Pollutants; Municipal Solid Waste Landfills". These include the New Source Performance Standards (NSPS) 40 *CFR Part* 60, *Subparts Cc and WWW.*

An increase in capture of gas from the facility is a direct decrease in fugitive emissions of gas into the atmosphere. Therefore capturing the gas using this method assists in the protection in air quality and the environment. If the methodology was not implored and the gas was allowed to escape prior to capture, into the atmosphere, it could potentially contribute to green house gases (GHG).

The amount of methane produced may increase from about 5% to over 150% above previous production levels. In another embodiment methane production is increased from about 10% to about 100% above previous production levels. When ventilating new waste bodies within each well location, the amount of methane produced may double or triple depending on the length of riser which was ventilated.

In conclusion, therefore, it is seen that the present invention and the embodiments disclosed herein are well adapted to carry out the objectives and obtain the ends set forth. Certain changes can be made in the subject matter without departing from the spirit and the scope of this invention. It is realized that changes are possible within the scope of this invention, and it is further intended that each element or step recited is to be understood as referring to all equivalent elements or steps. The description is intended to cover the invention as broadly as legally possible in whatever forms it may be utilized.

What is claimed is:

1. A method of producing landfill gas from an existing landfill gas recovery well, the method comprising (a) positioning an aperture tool within the internal diameter of the landfill gas recovery well casing made of polymer, said aperture tool comprising a housing, one or more pistons positioned inside the housing capable of extending from the housing to create an aperture through the landfill gas recovery polymer well casing with the one or more pistons directly exerting force against the polymer well casing to create apertures in the polymer without exerting pressure on the polymer casing except for the portion of the pistons creating the aperture, and passages in the housing to the piston to provide motive fluid;

(b) providing motive fluid to the one or more pistons of the aperture tool to create apertures through the landfill gas recovery well casing with a pressure ranging from about 1000 to about 3500 psi, and (c) producing landfill gas through the apertures after the apertures are created in the well casing.

2. The method of producing landfill gas from an existing landfill gas recovery well of claim 1, wherein the gas recovery well casing is a polymer.

3. The method of producing landfill gas from an existing landfill gas recovery well of claim 1, wherein the steps are repeated in more than one landfill gas recovery well casing.

4. The method of producing landfill gas from an existing landfill gas recovery well of claim 1, further comprising the step of d) collecting the landfill gas.

5. The method of producing landfill gas from an existing landfill gas recovery well of claim 4, wherein the landfill gas which meets New Source Performance Standards.

6. The method of producing landfill gas from an existing landfill gas recovery well of claim 1, wherein the aperture tool is capable of traveling through a non-vertical landfill gas well.

* * * * *